US005311454A

United States Patent [19]

Canales

[11] Patent Number: 5,311,454

[45] Date of Patent: May 10, 1994

[54] DIGITAL MULTIPLIER-ACCUMULATOR

[75] Inventor: Timothy J. Canales, Albuquerque, N. Mex.

[73] Assignee: Gulton Industries, Inc., Albuquerque, N. Mex.

[21] Appl. No.: 14,691

[22] Filed: Feb. 8, 1993

[51] Int. Cl.[5] ..... G06J 1/00

[52] U.S. Cl. ..... 364/606

[58] Field of Search ..... 364/606, 750.5, 602

[56] References Cited

U.S. PATENT DOCUMENTS 2,966,302 12/1960 Woolf et al. ..... 364/606

4,159,524 6/1979 Schollmeier et al. ..... 364/606

*Primary Examiner*—Long T. Nguyen

*Attorney, Agent, or Firm*—Darby & Darby

[57] ABSTRACT

A digital multiplier accumulator for performing the sum of products operation on two or more signal groups is described. The signal groups may be digitally coded and weighted. The multiplier accumulator will multiply selected signals from each signal group. Additionally, the multiplier accumulator can multiply the product of the signals by a scale factor. All of the products can then be summed to provide an analog output which represents the accumulated products of the digital inputs, scaled by the appropriate scale factor. The entire operation may be performed within a single logic element delay, since all the multiplication circuits operate in parallel and the summing is performed simultaneous to the multiplication. The digital multiplication is implemented with standard digital logic, while the analog multiplication and accumulation is implemented with a resistor array.

13 Claims, 8 Drawing Sheets

TRUTH TABLE UNIPOLAR CASE

| a | b | f(a,b) |
|---|---|---|
| F | F | F |
| F | T | F |
| T | F | F |
| T | T | T |

T = 1, F = 0

TRUTH TABLE BIPOLAR CASE

| a | b | f(a,b) |
|---|---|---|
| F | F | T |
| F | T | F |
| T | F | F |
| T | T | T |

T = +1, F = −1

FIG. 9

| i | j | k | l | $\alpha_k$ | $\beta_l$ | $\gamma_{i,j}$ | $R_{i,j,k,l}$ | $\delta_{i,j,k,l}$ |
|---|---|---|---|---|---|---|---|---|
| 1 | 4 | 0 | 0 | 0.25 | 0.25 | 1.0 | 16Z | 0.0625 |
| 1 | 4 | 0 | 1 | 0.25 | 0.50 | 1.0 | 8Z | 0.1250 |
| 1 | 4 | 1 | 0 | 0.50 | 0.25 | 1.0 | 8Z | 0.1250 |
| 1 | 4 | 1 | 1 | 0.50 | 0.50 | 1.0 | 4Z | 0.2500 |
| 2 | 3 | 0 | 0 | 0.25 | 0.25 | 1.0 | 16Z | 0.0625 |
| 2 | 3 | 0 | 1 | 0.25 | 0.50 | 1.0 | 8Z | 0.1250 |
| 2 | 3 | 1 | 0 | 0.50 | 0.25 | 1.0 | 8Z | 0.1250 |
| 2 | 3 | 1 | 1 | 0.50 | 0.50 | 1.0 | 4Z | 0.2500 |
| 3 | 2 | 0 | 0 | 0.25 | 0.25 | 1.0 | 16Z | 0.0625 |
| 3 | 2 | 0 | 1 | 0.25 | 0.50 | 1.0 | 8Z | 0.1250 |
| 3 | 2 | 1 | 0 | 0.50 | 0.25 | 1.0 | 8Z | 0.1250 |
| 3 | 2 | 1 | 1 | 0.50 | 0.50 | 1.0 | 4Z | 0.2500 |
| 4 | 1 | 0 | 0 | 0.25 | 0.25 | 1.0 | 16Z | 0.0625 |
| 4 | 1 | 0 | 1 | 0.25 | 0.50 | 1.0 | 8Z | 0.1250 |
| 4 | 1 | 1 | 0 | 0.50 | 0.25 | 1.0 | 8Z | 0.1250 |
| 4 | 1 | 1 | 1 | 0.50 | 0.50 | 1.0 | 4Z | 0.2500 |
| | | | | | | | $\Sigma\delta =$ | 2.2500 |

FIG. 10

| i | j | k | l | $R_{i,j,k,l}$ |
|---|---|---|---|---|
| 1 | 4 | 0 | 0 | 3.60KΩ |
| 1 | 4 | 0 | 1 | 1.80KΩ |
| 1 | 4 | 1 | 0 | 1.80KΩ |
| 1 | 4 | 1 | 1 | 900Ω |
| 2 | 3 | 0 | 0 | 3.60KΩ |
| 2 | 3 | 0 | 1 | 1.80KΩ |
| 2 | 3 | 1 | 0 | 1.80KΩ |
| 2 | 3 | 1 | 1 | 900Ω |
| 3 | 2 | 0 | 0 | 3.60KΩ |
| 3 | 2 | 0 | 1 | 1.80KΩ |
| 3 | 2 | 1 | 0 | 1.80KΩ |
| 3 | 2 | 1 | 1 | 900Ω |
| 4 | 1 | 0 | 0 | 3.60KΩ |
| 4 | 1 | 0 | 1 | 1.80KΩ |
| 4 | 1 | 1 | 0 | 1.80KΩ |
| 4 | 1 | 1 | 1 | 900Ω |

DIGITAL MULTIPLIER-ACCUMULATOR

The U.S. Government has a paid-up license in this invention and the right in limited circumstances to require the patent owner to license others on reasonable terms as provided for by the terms of contract No. NAS5-31488 (FG7461NC1H) awarded by the National Aeronautics and Space Administration.

FIELD OF THE INVENTION

This invention relates to signal processing circuits and systems. Specifically, this invention performs a "sum of products" operation on two or more digitally coded and weighted groups of signals to yield an analog result.

BACKGROUND OF THE INVENTION

Signal processing systems that perform a "sum of products" operation on digitally encoded signals are widely used in various filtering and signal conditioning applications. The object of these systems is to process digitally encoded and weighted signals to produce an analog output. The signal processing entails multiplying the digital input signals, summing the results of the intermediate multiplication procedures, and producing an analog output.

The "sum of products" operation can be defined for one or more signal groups. In the case of two signal groups, the "sum of products" expression is given as:

$$C = \sum_{j=1}^{n_b} \sum_{i=1}^{n_a} A_i \cdot B_j \cdot \gamma_{ij}$$

where

C is the final result (or system output);

$A_i$ is the $i^{th}$ signal from signal group A, where A is a group containing $n_a$ signals, each signal being $m_a$ bits long, and thus having resolution of $m_a$ bits;

$B_j$ is the $j^{th}$ signal from signal group B, where B is a group containing $n_b$ signals, each signal being $m_b$ bits long, and thus having a resolution of $m_b$ bits;

and, $\gamma_{i,j}$ is a constant or scale factor for the product of the $i^{th}$ signal from group A and the $j^{th}$ signal from group B.

Further, each element of the signal group A is represented as a weighted sum of $m_a$ bits and may be expressed as:

$$A_i = \sum_{k=0}^{m_a-1} a_{i,k} \cdot \alpha_k$$

where $a_{i,k}$ is the $k^{th}$ bit which has a value of plus or minus one in the case of a bipolar coding scheme, and zero or one in the case of a unipolar coding scheme, and $\alpha_k$ is the weight of the $k^{th}$ bit.

Similarly, the signal group B is represented as a weighted code of $m_b$ bits and may be expressed as:

$$B_j = \sum_{l=0}^{m_b-1} b_{j,l} \cdot \beta_l$$

where $b_{j,l}$ is the $l^{th}$ bit which has a value of plus or minus one in the case of a bipolar coding scheme, and zero or one on the case of a unipolar coding scheme, and $\beta_l$ is the weight of the $l^{th}$ bit.

Thus, the result, or system output, may be expressed as:

$$C = \sum_{j=1}^{n_b} \sum_{i=1}^{n_a} \sum_{l=0}^{m_b-1} \sum_{k=0}^{m_a-1} a_{i,k} \cdot b_{j,l} \cdot \alpha_k \cdot \beta_l \cdot \gamma_{i,j}$$

Several approaches to designing a digital multiplier accumulator to perform the necessary computations are widely used in the art. One approach is a mostly analog approach, characterized in that the digitally encoded signals are first converted to analog signals, through the use of a D/A converter or equivalent. These analog signals are then multiplied and summed in the analog domain, to produce the desired sum of products output. The analog multiplication may be achieved via either Gilbert cell or transconductance amplifier based techniques, while the addition may be accomplished through the use of traditional amplifier techniques.

The mostly analog approach yields a design with a relatively high operational speed; however, there are significant disadvantages. First, such an approach consumes a relatively high amount of power. Second, since this approach is very heavily dependent on analog circuitry, the performance of this approach is limited due to the inherently unstable nature (drift) of analog circuitry. The accuracy of the analog approach is typically in the range of 1 to 5%, with 1% being the limit of state of the art technology.

An alternative approach is the mostly digital approach, characterized in that it utilizes only digital processing elements. The digitally encoded signals are multiplied using well known digital multiplication techniques. The individual multiplication results are then summed using digital adders, to produce the system output which is the "sum of products."

The mostly digital approach is plagued by several disadvantages. First, due to the inherent computational delays within the digital multipliers and adders, this approach results in a relatively low operational speed. Second, due to the complexity of the digital processing elements used, this approach also consumes a relatively high amount of power. Also, in the digital approach, a digital to analog stage must be used in order to convert the digital result to an analog output.

Accordingly, it is an object of the present invention to provide a digital multiplier accumulator suitable for low power, high speed operation.

Another object of the present invention is to perform a digital multiplier accumulator operation within a time period corresponding to a single logic element delay.

It is another object of the present invention to provide a highly integrated digital multiplier accumulator, realized with standard Complementary Metal Oxide Semiconductor (CMOS) logic technology and thin film resistor technology.

Still another object of the present invention is the provision of a highly integrated digital multiplier accumulator achieved using Application Specific Integrated Circuit (ASIC) technology.

Additional objects and advantages of the invention will be set forth in the description which follows, and in part will be obvious to those skilled in the art from the description itself, and further will be appreciated by those practicing the invention and using the resulting digital multiplier accumulator.

In accordance with the present invention, the signals used in the multiplication and addition operations are broken down into sign and magnitude components. Since the sign component is limited in the number of input and output states that may be assumed, a digital logic implementation is conveniently used to perform the multiplication of the sign portion. The computation of the magnitude portion and the multiplication of the magnitude and sign portions of the signal is implemented with the use of a network of resistors that connect the output of the digital logic sign portion to the processing element output.

BRIEF DESCRIPTION OF THE DRAWINGS

The foregoing brief description or further objects, features, and advantages of the present invention will be understood more completely from the following description of presently preferred embodiments with reference to the drawings in which:

FIG. 9 is a table of parameters used in the convolver circuit; and

FIG. 10 is a table of resistors used in the convolver circuit.

DETAILED DESCRIPTION OF THE PREFERRED EMBODIMENTS

Figure 1:
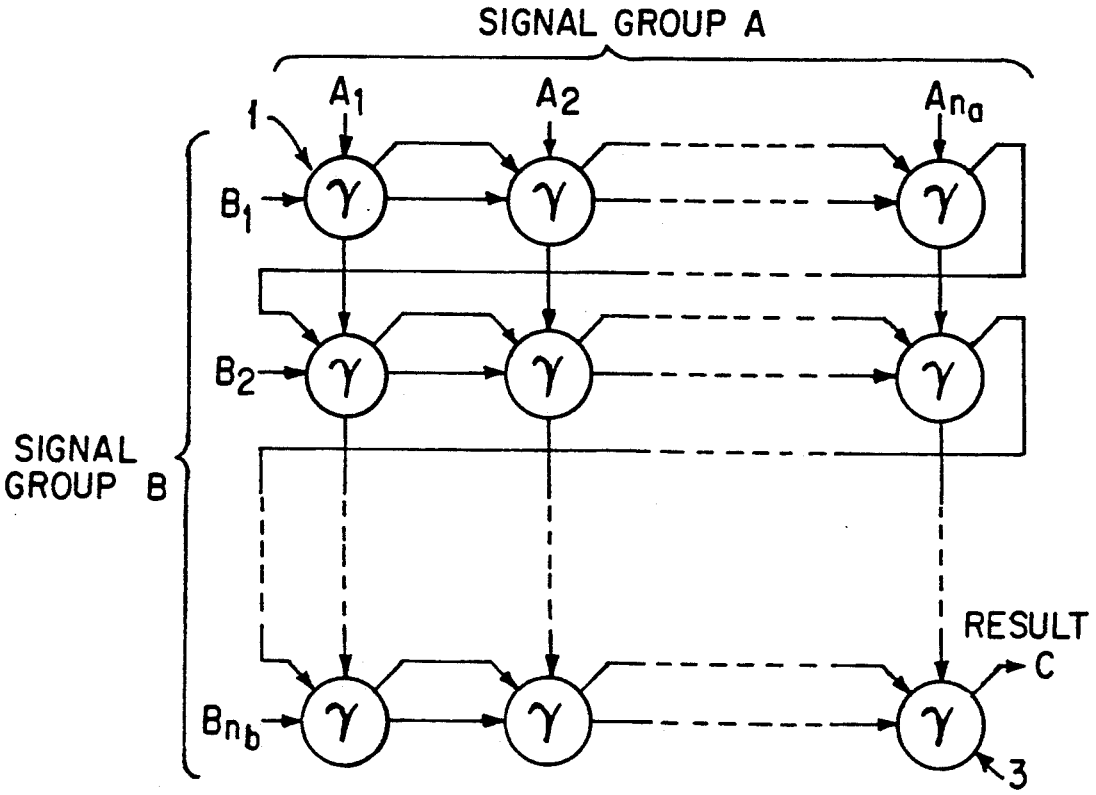
FIG. 1 PRIOR ART
FIG. 1 is a functional block diagram of a prior art general sum of products architecture.
Figure 2:
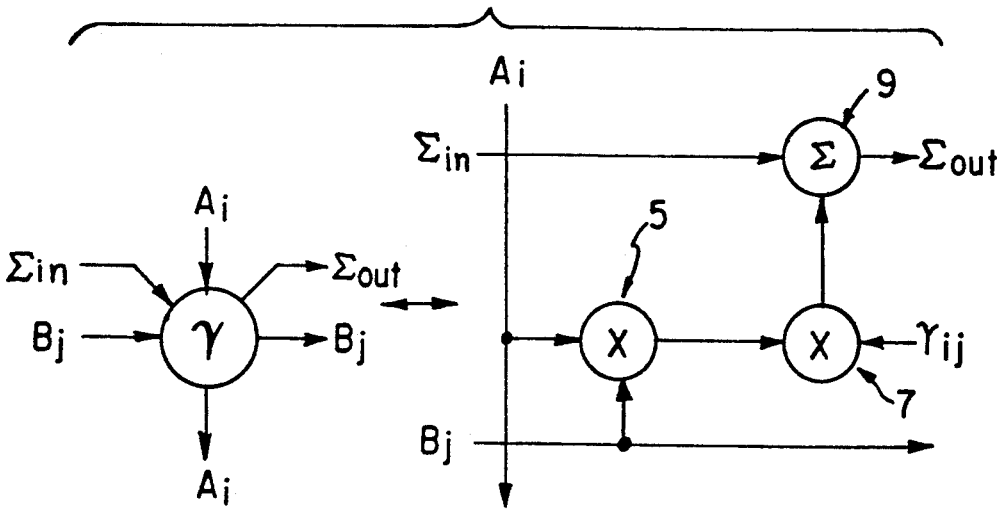
FIG. 2 PRIOR ART
FIG. 2 is a functional block diagram of a prior art individual processing element that is used to construct a general sum of products architecture.

FIG. 1 shows a generalized structure used to implement a sum of products architecture. The structure is an $n_a$ by $n_b$ array of processing elements 1, which are shown in further detail in FIG. 2. As previously mentioned, $n_a$ is the number of signals in the A signal group, and $n_b$ is the number of signals in the B signal group. FIG. 2 shows the actual signal processing carried out within each processing element. An individual A signal, $A_i$, is multiplied by an individual B signal, $B_j$. This multiplication is carried out by multiplier 5. Since $A_i$ is a signal that is $m_a$ bits wide, and $B_j$ is a signal that is $m_b$ bits wide, the multiplier 5 is actually an $m_a$ by $m_b$ bit multiplier. This intermediate result is then multiplied by the scale factor $\gamma_{ij}$ (carried out by multiplier 7) and added to the $\Sigma_{in}$ from a previous processing element to produce a $\Sigma_{out}$ which is then used as a $\Sigma_{in}$ by a successive processing element. This addition is carried out by adder 9.

The computation starts at the upper left processing element 1 of FIG. 1 and continues across the row of processing elements, with each processing element using the $\Sigma_{in}$ from a previous processing element and providing its $\Sigma_{out}$ as the $\Sigma_{in}$ input to the next processing element. As indicated in FIG. 1, the first processing element 1 in the computation chain does not have a $\Sigma_{in}$ input since there is no previous processing element. Also, the last processing element in each row provides its $\Sigma_{out}$ as the $\Sigma_{in}$ to the first processing element in the next row. Finally the $\Sigma_{out}$ of the last processing element 3 in the last row is the result or system output.

Figures 3, 12:
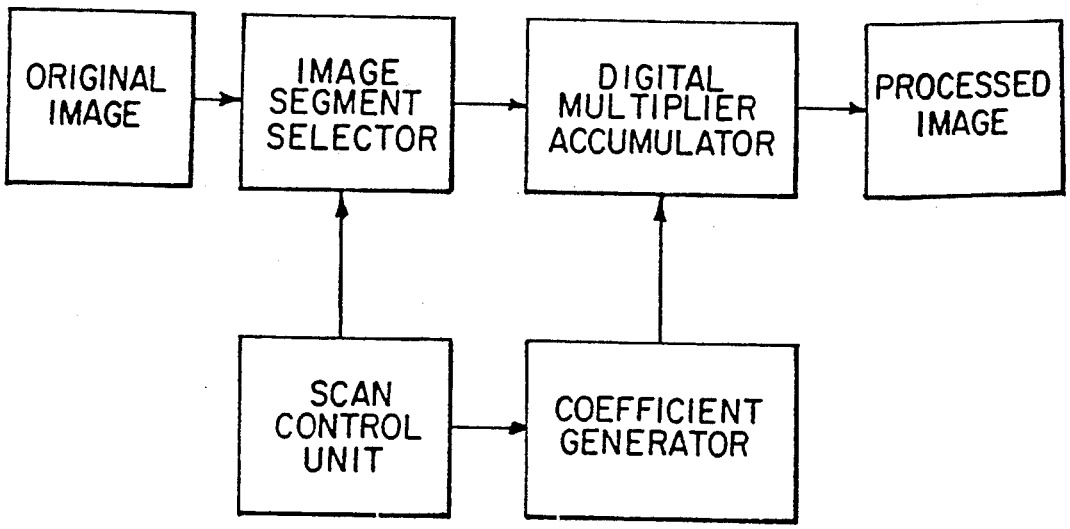
FIG. 3 is the truth tables used in implementing the multiplication of the sign portion.
FIG. 12 is a functional block diagram of a spatial filtering system employing a digital multiplier accumulator.

In the preferred embodiment of the present invention, the multiplication operation is separated into a sign portion and a magnitude portion. For example, in the case of a sum of products operation for two signal groups, the result or system output may be expressed as:

$$C = \sum_{j=1}^{n_b} \sum_{i=1}^{n_a} \sum_{l=0}^{m_b-1} \sum_{k=0}^{m_a-1} a_{i,k} \cdot b_{j,l} \cdot \alpha_k \cdot \beta_l \cdot \gamma_{i,j}$$

where the sign portion is the product of the a and b elements. In the case of unipolar signal coding, the sign portion has a value of zero or one. In the case of bipolar signal coding, the sign portion may have a value of plus one or minus one. Since the input and output states are limited in number (in the case of unipolar or bipolar coding, there are only two possible states), a digital logic implementation may be used. The inputs are the a and b values, and the output is the product function of a and b, which is represented as f(a,b). FIG. 3 shows the truth tables used to determine the function f(a,b) and its corresponding digital implementation, for mapping the input signals a and b to the output function f(a,b) which is in reality the product of a and b.

As FIG. 3 shows, in the case of unipolar coding, the logic function used to implement the multiplication of a and b, f(a,b) reduces to the logical AND function. Similarly, in the case of bipolar coding, the logic function reduces to the logical EXCLUSIVE NOR or XNOR function.

The magnitude portion of the multiplication operation is the multiplication of $\alpha$, $\beta$, and $\gamma$ to produce a magnitude portion denoted as $\delta$. This magnitude portion is implemented with a resistance whose value is inversely proportional to the $\alpha \cdot \beta \cdot \gamma$ product.

Figure 4:
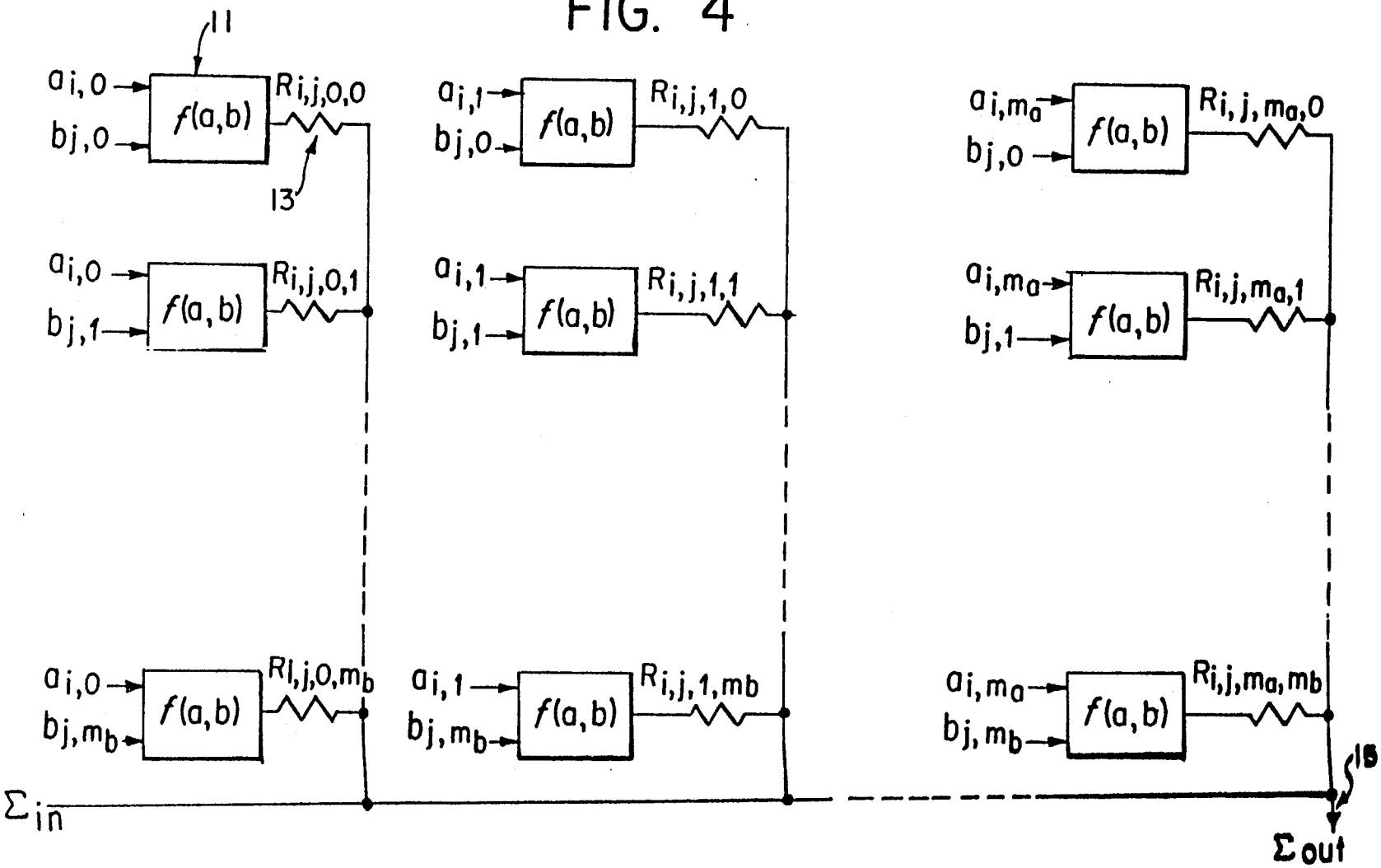
FIG. 4 is a functional block diagram of a processing element that performs the multiplication of both the sign and magnitude portions, the D/A conversion of each intermediate bit result, and the addition of the intermediate bit results on a bit by bit basis to produce an intermediate output.

FIG. 4 illustrates a processing element according to the preferred embodiment of the present invention which may be used in the case of two signal groups. This processing element may be used to construct a sum of products architecture similar to that of FIG. 1; however, there are a few distinctions which will be brought to light. Referring now to FIG. 4, this processing element performs the multiplication of the $i^{th}$ element of the A signal group with the $j^{th}$ element of the B signal group, and the scaling of this result by the corresponding $\gamma_{ij}$ scaling factor.

As previously mentioned, the $i^{th}$ element of the A signal group, $A_i$ is $m_a$ bits long, and the $j^{th}$ element of the B signal group, $B_j$ is $m_b$ bits long. Thus, the processing element of FIG. 4 is an array of functional blocks and corresponding resistors of size $m_a$ by $m_b$. Each of the functional blocks 11 of FIG. 4 implements the appropriate truth table of FIG. 3, depending on whether unipolar or bipolar coding is being used. This functional block 11 actually carries out the multiplication of the sign portion for a specific bit of $A_i$ and a specific bit of $B_j$.

Each functional block has attached to it a resistor, such as resistor 13 for functional block 11. The size of this resistor and the method in which it is connected in the processing element perform several operations. First, the size of the resistor is used to implement the multiplication product $\alpha \cdot \beta \cdot \gamma = \delta$. Second, the connection of the resistor on one side to the functional block 11 and on the other side to the $\Sigma_{out}$ node 15 performs the multiplication of the sign portion with the magnitude portion and provides this intermediate result to the $\Sigma_{out}$ node 15 where it is summed with all the other intermediate sign magnitude products. The summing is actually the addition of voltage contributions from each individual processing element.

Figure 5:
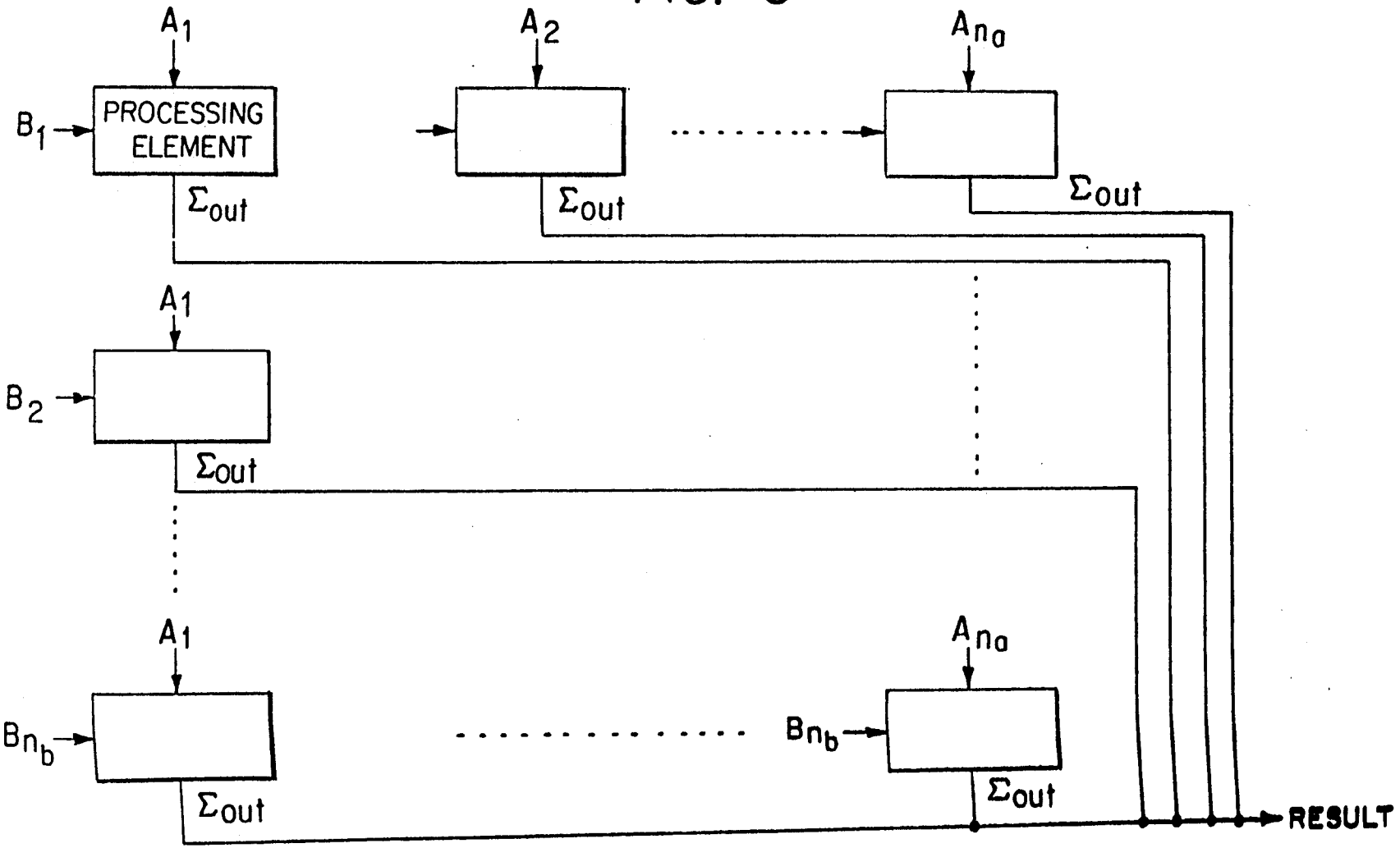
FIG. 5 is a functional block diagram of the sum of products architecture implemented using the processing elements of FIG. 4.

FIG. 4 illustrates the high speed nature of the present invention. Each sign magnitude product produced by a functional block 11 and resistor 13 is simultaneously summed with all the other sign magnitude products at the $\Sigma_{out}$ node 15. This principle of simultaneous summing is also applied to the overall architecture of FIG. 5 which is implemented with the processing elements of FIG. 4. The $\Sigma_{out}$ of each processing element is simultaneously summed at the result output node 25. As FIGS. 4 and 5 indicate, only one set of resistors is required to form the $\alpha \cdot \beta \cdot \gamma$ product. Alternatively, one set of resistors may be used to perform the $\alpha \cdot \beta$ product, and then another set of resistors could be used to multiply that result by $\gamma$.

According to the present invention, the only delay in the entire sum of products computation is a single logic element delay of the functional block 11 of FIG. 4. Previous implementations, such as that of FIG. 1, have a significant delay from input to output. This is due to the $\Sigma_{out}$ of each element being used as the $\Sigma_{in}$ to the next element, resulting in a propagation delay from input to output that is the cumulative delay through each processing element, since each processing element must wait for the $\Sigma_{out}$ of the previous element.

In the case of more than two signal groups, the digital multiplier accumulator is just constructed to accommodate however many signal groups are being processed. For example, in the case of four signal groups, each functional block would have four inputs. Consequently, the digital logic used to implement the sign multiplication being carried out in the functional block would be a function of the four inputs. Also, each resistor used to connect a functional block to the summing node would be sized taking into account weighting factors for four signals, as well as the scaling factor.

The digital multiplier accumulator of the present invention may be implemented using Complementary Metal Oxide Semiconductor (CMOS) circuits. Standard digital logic gates, as is well known in the art, may be used to implement the functional blocks used to multiply the sign portion of the input signals. Alternatively, all the digital logic used in the multiplier accumulator may be integrated into a custom or semi-custom Application Specific Integrated Circuit (ASIC).

The digital multiplier accumulator of the present invention may, for example, utilize standard discrete resistors that are well known in the art. Alternatively, all the resistors may be combined utilizing thin film resistor technology. In thin film resistor technology, several resistors may be fabricated in one electronic component package, thus providing integration and potentially resulting in significant size and cost savings.

Figure 6:
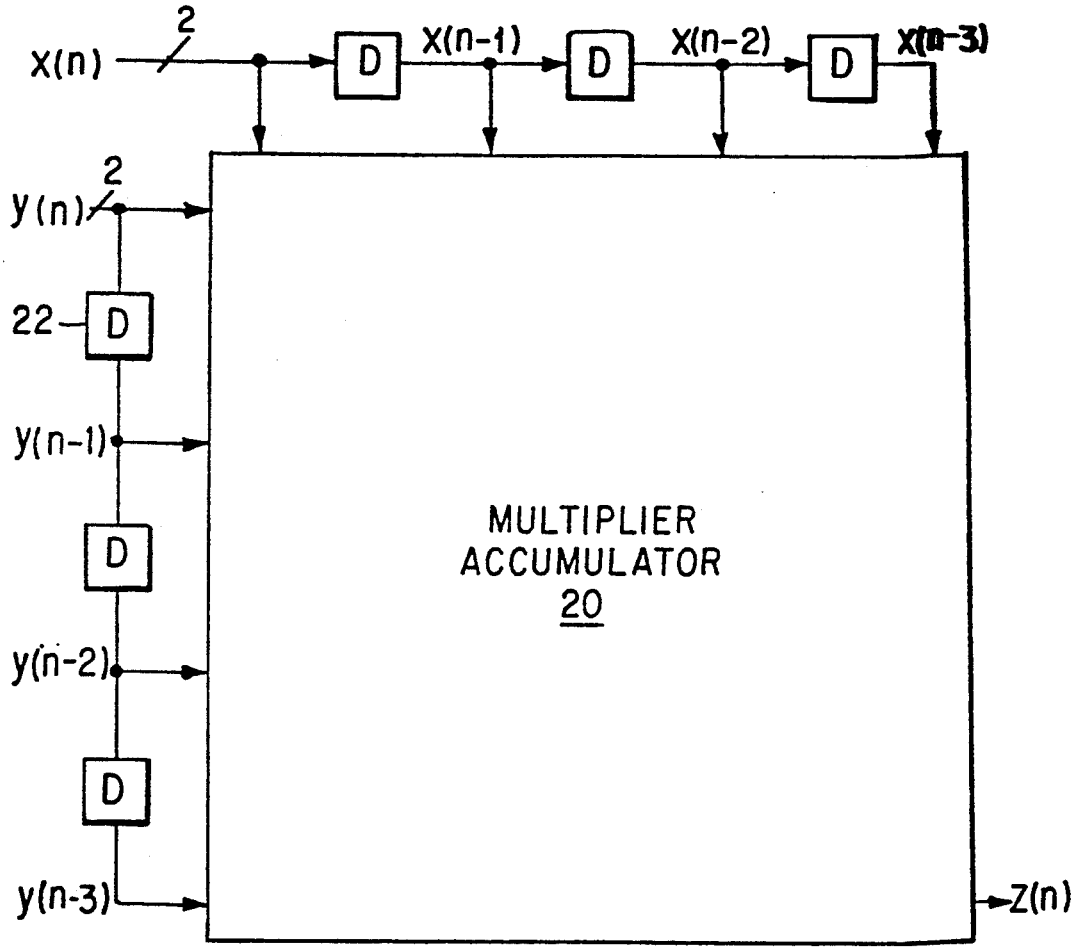
FIG. 6 is a functional block diagram of a four stage convolver circuit.

The present invention may be used, for example, in a convolution circuit as shown in FIG. 6. The multiplier accumulator 20 has as its input, two groups of signals, x and y. Each group of signals has four elements, which in the case of the x group are: x(n), x(n−1), x(n−2), and x(n−3). The four elements are produced from a single data stream by using delay blocks 22. Thus x(n) is the present value of the data stream, x(n−1) is the value of the data stream one delay period prior, x(n−2) is the value of the data stream two delay periods prior, and x(n−3) is the value of the data stream three delay periods prior. The elements of the y signal group are achieved in much the same manner.

The multiplier accumulator 20 in FIG. 6 multiplies selected elements of the x signal group with selected elements of the y signal group and sums the intermediate results. This is illustrated in more detail in FIG. 7, which shows the use of the processing elements 24 that actually perform the multiplication and the summing node 26 where the intermediate results are summed and output as the signal z(n).

Figure 7:
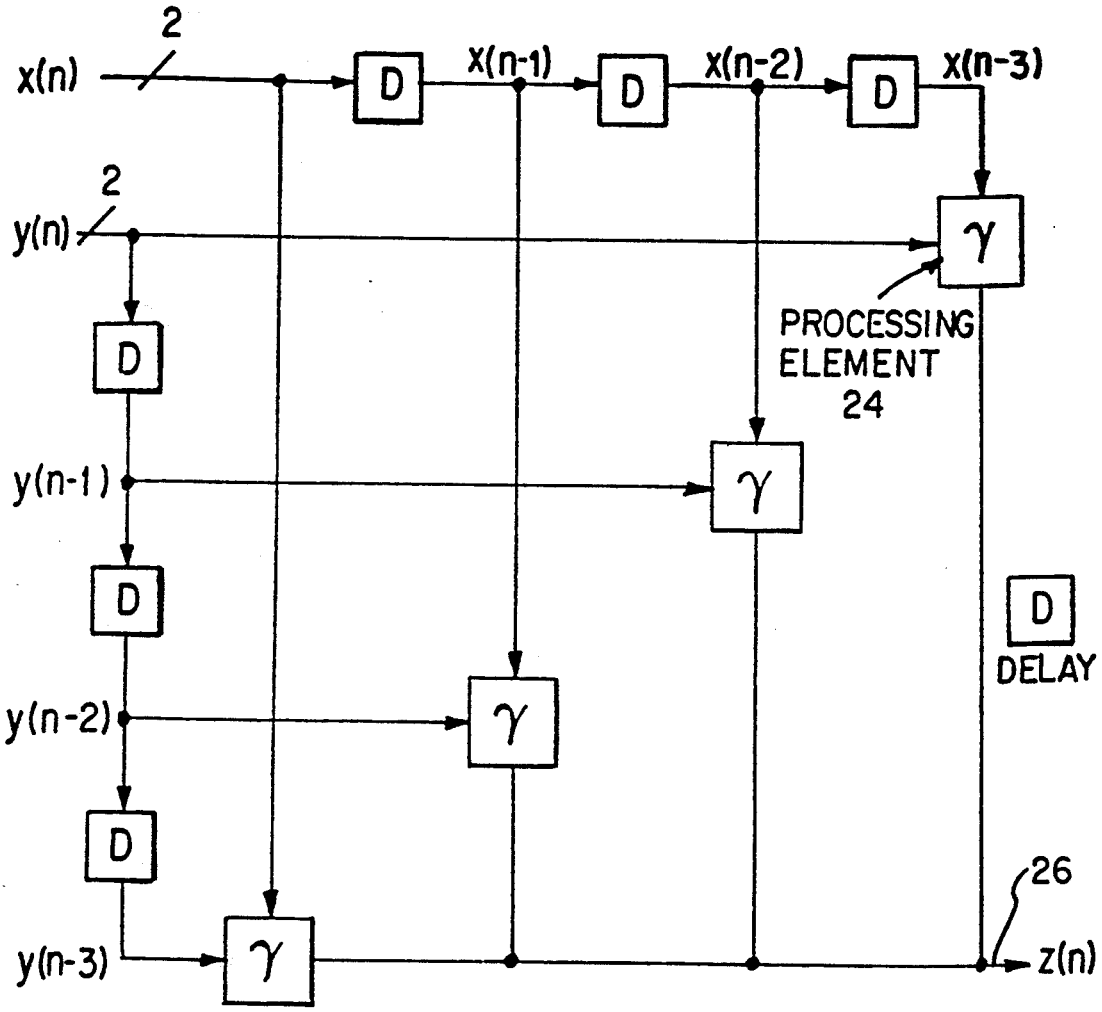
FIG. 7 is a functional block diagram of the four stage convolver circuit of FIG. 6, showing the individual processing elements used to construct the multiplier accumulator.

The convolver circuit of FIG. 7 implements the convolution of the x signal group with the y signal group. This is represented as:

$$z(n) = \sum_{i=1}^{4} x(n-i+1) \cdot y(n+i-4)$$

which may also be expressed as:

$$z(n) = \sum_{j=1}^{4} \sum_{i=1}^{4} A_i \cdot B_j \cdot \gamma_{i,j}$$

In this example, the signal groups A and B can be defined as:

$$A_1 = x(n) \qquad B_1 = y(n)$$
$$A_2 = x(n-1) \qquad B_2 = y(n-1)$$
$$A_3 = x(n-2) \qquad B_3 = y(n-2)$$
$$A_4 = x(n-3) \qquad B_4 = y(n-3)$$

while the constants $\gamma_{ij}$ are defined as:

$$\gamma_{ij} = 1 \text{ if } (i+j-1) = 4; = 0, \text{ otherwise.}$$

Figure 8:
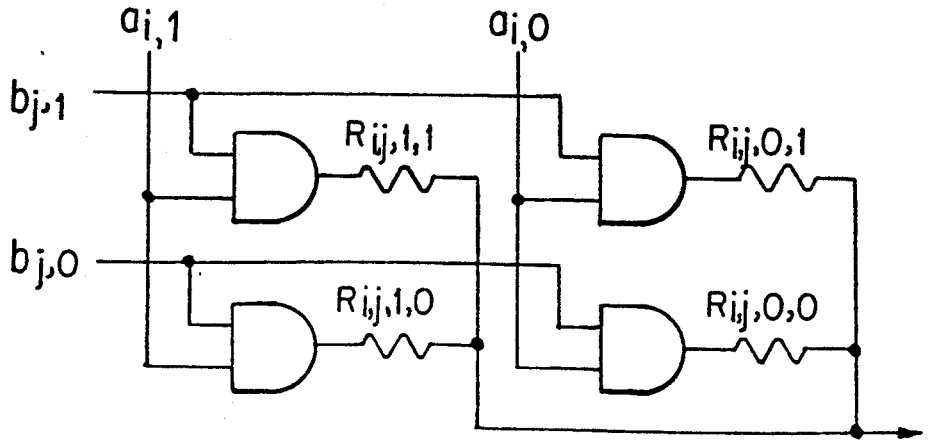
FIG. 8 is a functional block diagram of a processing element of FIG. 7.

In the present example, each signal element has two bit resolution and utilizes unipolar coding, so that:

$$A_i = a_{i,1} \cdot \alpha_1 + a_{i,0} \cdot \alpha_0$$

$$B_j = b_{j,1} \cdot \beta_1 + b_{j,0} \cdot \beta_0$$

where the bit weights are $\alpha_0 = \beta_0 = 2^{-2} = 0.25$, and $\alpha_1 = \beta_1 = 2^{-1} = 0.50$. Since unipolar signals are being used, logical AND gates will be used within the processing elements to perform the multiplication of the sign portion. This is shown in FIG. 8.

In order to determine the resistor value associated with each logic gate, it will be recalled that the value of each resistor is inversely proportional to the specific $\alpha \cdot \beta \cdot \gamma = \delta$ product for that logic gate. Thus, based on the known $\alpha$, $\beta$, and $\gamma$ values, relative resistor values may be determined. These are shown in FIG. 9, where Z is a constant of proportionality between the relative resistor values and the absolute resistor values. The specific resistor values, and thus the value of Z may be determined by working backwards from the desired output impedance, $R_0$, of the overall convolver circuit. The relationship between the specific resistor values and the output impedance $R_0$ is:

$$R_{i,j,k,1}=(\Sigma\delta/\delta_{i,j,k,1})\cdot R_0$$

where $\delta_{i,j,k,1}=\alpha_k\cdot\beta_1\cdot\gamma_{ij}$ and $\Sigma\delta$ is the sum of all $\delta$'s. As can be seen from FIG. 9, $\Sigma\delta$ for this example is 2.25. Thus, if an output impedance of 100Ω is desired, the specific resistor values will be as shown in FIG. 10.

For the convolution circuit example, the maximum output level will occur when both inputs have maximum values of 0.75 for at least four delay periods. The 0.75 value is a result of the sign portion of each signal being high and then multiplied by the appropriate weighting factor. Thus, for example:

$$A_i=a_{i,1}\cdot\alpha_1+a_{i,0}\cdot\alpha_0$$

and if $a_{i,1}=1$ (high) and $a_{i,0}=1$ (high), the expression for $A_i$ reduces to:

$$A_i=1.0.50+1.0.25=0.75$$

Therefore, the maximum output value of the four stage convolver circuit will be 4(0.75)(0.75)=2.25, which represents the accumulated output of four multipliers, each one multiplying the maximum value of A and the maximum value of B. The minimum output value will be 0.

Since the convolver circuit may, for example, be implemented with standard digital logic (1 or logic high=5 V and 0 or logic low=0 V), the maximum output of the circuit, 2.25, will be represented by 5 V. Thus, the convolver circuit has a built in gain value of 2.22 which is simply 5 V/2.25.

Figure 11:
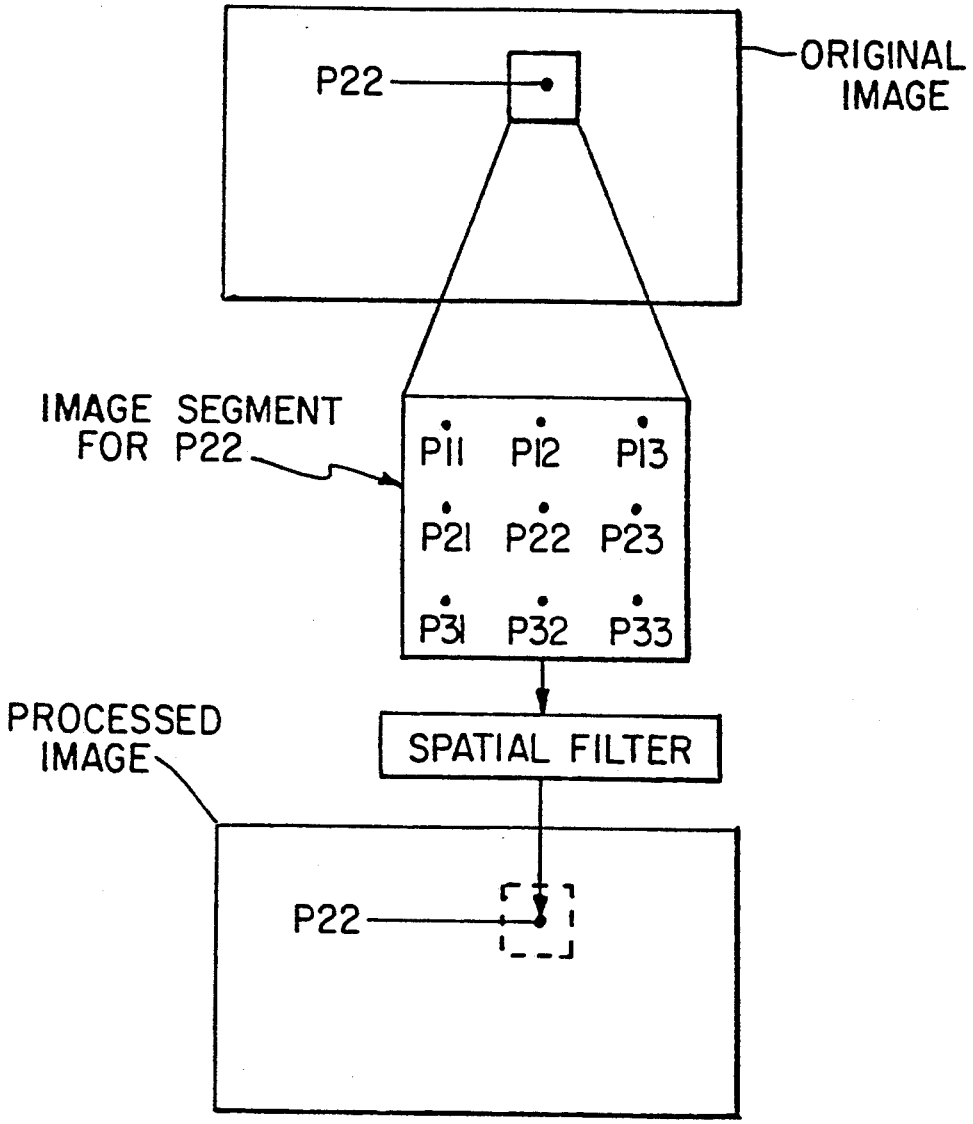
FIG. 11 is a diagram illustrating a spatial filtering application.

The present invention may also be used, for example, in an image processing system. An image is a two dimensional sequence of points of varying intensity or varying intensity and varying color. In image processing, spatial filtering operations can be used to enhance various image properties such as edge detection, averaging, motion detection, and interpolation. These operations generally transform an original image into a processed image, by processing each point. Each point in the processed image is a function of that point's image segment, defined to be the point itself and the point's neighboring points. This is illustrated in FIG. 11, where the image segment corresponding to point $P_{22}$ is processed by a spatial filter to yield a processed image point $P'_{22}$. The process entails weighted multiplication of the points in the image segment and accumulation to determine the processed image point.

Spatial filtering can be implemented as a sum of products operation, and in particular can be implemented with the digital multiplier accumulator of the present invention. This is shown in FIG. 12. In this implementation, a scan control unit sequentially selects image segments from the original image. At the same time, processing coefficients are generated for the particular image point to be processed. Different image points in the same image may require different processing coefficients since not all image points will be undergoing the same transformation. For example, some regions of an image might require edge detection while other regions would require averaging.

The image segment and its processing coefficients are processed by the digital multiplier accumulator to yield an analog video signal that represents the processed image point. If the image is scanned linearly from top to bottom and side to side, a raster scan video will be produced that can be used to drive one color channel of a color video display monitor. Since image processing is commonly performed on each color component individually, an RGB (red-green-blue) image would require a total of three image processors.

While the invention has been particularly shown and described with reference to preferred embodiments thereof, it will be understood by those skilled in the art that various changes in form and detail may be made therein without departing from the spirit and scope of the invention.

I claim:

1. A circuit for performing a sum of products operation on a plurality of digitally coded and weighted groups of signals to yield an analog result, each group of signals comprising a plurality of elements, each element comprising a plurality of individual signals, each individual signal having a sign portion and a magnitude portion, the circuit comprising:

a circuit output node;

a digital multiplier having an output and a plurality of inputs, a first one of said plurality of inputs being connected to receive the sign portion of a first individual signal of a first element of a first group of said digitally coded and weighted groups of signals, a second one of said plurality of inputs being connected to receive the sign portion of a first individual signal of a first element of a second group of said digitally coded and weighted groups of signals, said digital multiplier producing a digital product at the output of the digital multiplier;

and an analog multiplier having an output and a plurality of inputs, a first one of said plurality of inputs being connected to receive the digital product from the output of the digital multiplier, a second one of said plurality of inputs being connected to receive the magnitude portion of the first individual signal of the first element of the first group of said digitally coded and weighted groups of signals, a third one of said plurality of inputs being connected to receive the magnitude portion of the first individual signal of the first element of the second group of said digitally coded and weighted groups of signals, a fourth one of said plurality of inputs being connected to receive a scale factor, said analog multiplier producing an analog signal at the output of the analog multiplier, the output of the analog multiplier being connected to the circuit output node.

2. The circuit of claim 1 wherein the analog multiplier comprises a preselected resistor.

3. A system comprising a plurality of circuits according to claim 2, and further comprising a plurality of resistors, each one of said plurality of resistors connected between the circuit output node of each one of the plurality of circuits, respectively, and a summing node of the system, said plurality of resistors accumulating the analog signal of each one of the plurality of circuits, to produce a system output at the summing node.

4. The system according to claim 3 wherein each of the plurality of resistors for accumulating and the preselected resistor for each of the plurality of circuits are combined into a plurality of single resistors.

5. The system according to claim 4 wherein the sum of products operation is performed within a time period substantially corresponding to a single logic element delay.

6. The system according to claim 5 wherein the digitally coded and weighted groups of signals are encoded using a unipolar coding scheme.

7. The system according to claim 6 wherein the digital multiplier comprises a logical AND gate.

8. The system according to claim 7 wherein the logical gates are implemented with Complementary Metal Oxide Semiconductor (CMOS) circuits.

9. The system according to claim 8 wherein the plurality of single resistors is implemented with thin film resistor technology.

10. The system according to claim 5 wherein the digitally coded and weighted groups of signals are encoded using a bipolar coding scheme.

11. The system according to claim 10 wherein the digital multiplier comprises a logical EXCLUSIVE NOR (XNOR) gate.

12. The system according to claim 11 wherein the logical gates are implemented with Complementary Metal Oxide Semiconductor (CMOS) circuits.

13. The system according to claim 12 wherein the plurality of single resistors is implemented with thin film resistor technology.

* * * * *